US008453861B2

(12) United States Patent
Joubert

(10) Patent No.: US 8,453,861 B2
(45) Date of Patent: Jun. 4, 2013

(54) TRANSPORT OF GOODS

(75) Inventor: Simon John Joubert, Port Elizabeth (ZA)

(73) Assignee: Mechana CC, Sidwell (ZA)

( * ) Notice: Subject to any disclaimer, the term of this patent is extended or adjusted under 35 U.S.C. 154(b) by 0 days.

(21) Appl. No.: 13/123,508

(22) PCT Filed: Oct. 9, 2009

(86) PCT No.: PCT/IB2009/054440

§ 371 (c)(1),
(2), (4) Date: Apr. 8, 2011

(87) PCT Pub. No.: WO2010/041222

PCT Pub. Date: Apr. 15, 2010

(65) Prior Publication Data

US 2011/0192760 A1 Aug. 11, 2011

(30) Foreign Application Priority Data

Oct. 10, 2008 (ZA) ..... 2008/08681

(51) Int. Cl.
*B65D 6/16* (2006.01)
*B65D 19/16* (2006.01)

(52) U.S. Cl.
USPC ..... 220/4.28; 220/6; 206/600

(58) Field of Classification Search
USPC ..... 206/517, 600, 511, 512, 509, 507, 206/505; 217/45, 43 R
IPC ..... B65D 6/16,8/14, 19/12, 19/16, 85/62, B65D 21/036, 21/032
See application file for complete search history.

(56) References Cited

U.S. PATENT DOCUMENTS 3,949,929 A 4/1976 Kupersmit
4,186,841 A * 2/1980 Buckley et al. ..... 220/6
4,591,065 A * 5/1986 Foy ..... 220/7

(Continued)

FOREIGN PATENT DOCUMENTS

DE 4208614 9/1993
DE 4445678 4/1996

(Continued)

OTHER PUBLICATIONS

International Preliminary Report on Patentability (Chapter 1 of the Patent CooperationTreat) issued in PCT Application No. PCT/IB09/054440, Apr. 12, 2011, 7 pages.

(Continued)

*Primary Examiner* — Mickey Yu
*Assistant Examiner* — Robert J Hicks
(74) *Attorney, Agent, or Firm* — Klarquist Sparkman, LLP

(57) ABSTRACT

A collapsible container includes a base two ends and one or two sides. Two pairs of lifting element guide formations are connected to the base. The ends are displaceable relative to the base between an erect condition in which they extend upwardly from opposed ends of the base and a collapsed condition in which they are generally parallel with the base. The ends have a width which is less than the spacing between the lifting element guide formations in a pair such that when two or more of the containers are arranged in a stack, in their collapsed conditions, ends of one container are positioned between the lifting element guide formations of a container positioned immediately above said one container in a stack.

12 Claims, 9 Drawing Sheets

U.S. PATENT DOCUMENTS

| | | | | |
|---|---|---|---|---|
| 4,662,532 | A * | 5/1987 | Anderson et al. | 220/7 |
| 5,145,311 | A * | 9/1992 | Salvucci | 414/592 |
| 5,507,237 | A * | 4/1996 | Barrow et al. | 108/55.1 |
| 2011/0186568 | A1* | 8/2011 | Joubert | 220/1.5 |

FOREIGN PATENT DOCUMENTS

| | | |
|---|---|---|
| DE | 202008007945 | 8/2008 |
| EP | 0048577 | 3/1982 |
| EP | 1574444 | 9/2005 |
| FR | 1593223 | 5/1970 |
| FR | 2079992 | 11/1971 |
| FR | 2751618 | 1/1998 |
| GB | 1299219 | 12/1972 |

OTHER PUBLICATIONS

Written Opinion issued in PCT Application No. PCT/IB2009/054440, mailed Feb. 15, 2010, 6 pages.

International Search Report issued in PCT Application No. PCT/IB2009/052689, mailed Sep. 30, 2009, 5 pages.

Written Opinion issued in PCT Application No. PCT/IB2009/052689, mailed Sep. 29, 2009, 7 pages.

International Preliminary Report on Patentability, issued in PCT Application No. PCT/IB2009/052689, mailed Sep. 6, 2010, 12 pages.

* cited by examiner

TRANSPORT OF GOODS

CROSS REFERENCE TO RELATED APPLICATIONS

This is the U.S. National Stage of International Application No. PCT/IB2009/054440, filed Oct. 9, 2009, which was published in English under PCT Article 21(2), which in turn claims the benefit of South Africa Application No. 2008/08681, filed Oct. 10, 2008, both of which are incorporated herein by reference in their entirety.

FIELD

THIS INVENTION relates to the transport of goods, particularly to containers for the transport of goods.

BACKGROUND

The transportation costs of goods is usually calculated using either the weight of the goods and/or the volumetric capacity, and therefore it can be accepted that the weight, and volumetric space that is made up by packaging with or without goods contained therein, has a direct and often linear influence on the cost and the transportation of such goods.

Accordingly, it will be appreciated that, when transporting packaging containing goods, of the total volumetric capacity occupied by the structure with the goods contained therein, the space occupied by the actual packaging structure, and any unnecessary air space, should be kept to a minimum so as not to add unnecessarily to the transportation cost of the goods.

Furthermore, if the transportation cost is calculated upon volumetric capacity alone, and should the packaging contain the same volumetric dimensions once it has been emptied, then the costs of returning such packaging once it has been emptied will be equal to the cost of delivering the packaging containing the goods.

The inventor is aware of containers for the transport goods which define a load space in which the goods are receivable. The problem with these containers is that after the transport of goods to a desired destination, the containers are costly to return to the point of departure, and are often destroyed at their destination, also at a cost and at the expense of natural resources.

In an attempt to address this problem, the inventor is aware of collapsible containers which have an erect condition in which they define a goods receiving volume in which goods to be transported are receivable and a collapsed condition in which the volume occupied by the container is less than when in its erect condition thereby reducing the cost of transporting empty containers.

While it makes economic sense to re-use the packaging, the cost to return the packaging once it has been emptied does not contribute any value to the delivered goods and therefore it is an additional expense which increases the cost of the goods delivered.

It can therefore be concluded that the design of packaging to be returned has a direct influence on the transportation cost of the goods delivered therein, and that in so far as possible, the packaging must be designed to limit the cost attached to the transport of goods.

It is an object of the invention to provide a collapsible container which the Inventor believes will at least ameliorate this problem.

SUMMARY

According to one aspect of the invention there is provided a collapsible container which includes:

a base;

two pairs of lifting element guide formations, the lifting element guide formations in each pair protruding downwardly from the base at transversely spaced registering positions; and at least two ends connected to the base for displacement between an erect condition in which they extend upwardly from opposed ends of the base and a collapsed condition in which they are generally parallel with the base, the ends having a width which is less than the spacing between the lifting element guide formations in a pair such that when two or more of the containers are arranged in a stack, in their collapsed conditions, ends of one container are positioned between the lifting element guide formations of a container positioned immediately above said one container in the stack.

For improved space utilization and the transportation and storage of goods, in the erect condition a plurality of the containers may be stackable one on top of the other.

The container may include complementary upper and lower support formations configured such that when a plurality of like containers is arranged in a stack the lower support formations of one container cooperate with the upper support formations of a subjacent container.

The lifting element guide formations may be configured such that a lifting tine of a forklift or a rolling support of the pallet jack is receivable therein. Typically, the tines of a forklift have a height of 45 mm or less whereas, the rolling supports of a pallet jack typically have a height of about 90 mm or less. In order to provide appropriate clearance, the depth of the lifting element guide formations should typically be at least 95 mm.

The depth of the lifting element guide formations may be greater than the height which the ends protrude above the base when the container is in its collapsed condition such that when two or more containers are arranged in a stack the base of said one container is supported with clearance above the ends of the subjacent container.

The spacing between the base of one container and the ends of the container may be at least 45 mm to permit insertion of the tines of the forklift between the containers The base typically includes a frame comprising a pair of parallel side members and a pair of parallel end members connected to and extending between the side members. The side members may be formed of square tubing and the end members may be formed of angle iron which is secured, typically by welding, to bottom surfaces of the end members.

The lifting element guide formations may include generally u- or staple-shaped members which are attached to and depend from the side members.

The staple-shaped members may be formed from flat bar and comprise a central portion and two end portions which are bent perpendicular to the central portion, the central portion extending parallel to the side member to which the staple-shaped member is attached.

The provision of the lifting element guide formations serves to locate a container on a forklift or pallet jack and thereby restrain relative movement therebetween. This is an important consideration since a number of the containers may be stacked one on top of the other and the risk exists that the containers may shift laterally when cornering or on uneven road surfaces while in motion. A further advantage of making use of the lifting element guide formations is that they permit lateral tilting of the container, e.g. to pour the contents therefrom which could be achieved by rotating the tines of a forklift. They also serve to inhibit forward tilting of the container during braking or movement down a decline.

A downwardly open guide element may be connected to and extend between the associated staple-shaped members in a pair.

A pair of longitudinally spaced locating formations may protrude upwardly from at least one of the side members, the spatial arrangement of the locating formations being complementary to that of the lifting element guide formations such that they cooperate and serve to locate adjacent containers arranged in a stack relative to one another.

The ends may be pivotally connected to the base. Each end may include support formations which, in the erect condition of the container abut a support surface, e.g. the ground on which the container is resting.

The container may include at least one side which is disconnectedly connectable to the ends. The side may be pivotally connected to the base for pivotal displacement between an erect condition and a collapsed condition. In its collapsed condition, the side may be received, at least partially, within the base. Preferably, the container includes two sides which, in the erect condition of the container extend upwardly from opposite sides of the base. It will be appreciated that in order to fit within the base the or each side will have a height which is less than the width of the base.

According to another aspect of the invention there is provided a collapsible container which includes:

a base;

at least two ends connected to the base for displacement between an erect condition in which they extend upwardly from opposed ends of the base and a collapsed condition in which they are generally parallel with the base; and downwardly directed support formations depending from the base and configured to cooperate with complementary support formations on a like container when the containers are either in their erect condition or in their collapsed condition to facilitate stacking of the containers one on top of the other.

When a plurality of the containers in their collapsed condition is arranged in a stack the base of one container may be supported with clearance between the base of said one container and the ends of an adjacent container. This arrangement permits the insertion of the tines of a forklift between adjacent containers in a stack.

BRIEF DESCRIPTION OF THE DRAWINGS

The invention will now be described, by way of example, with reference to the accompanying diagrammatic drawings.

In the drawings.

DETAILED DESCRIPTION

Figure 1:
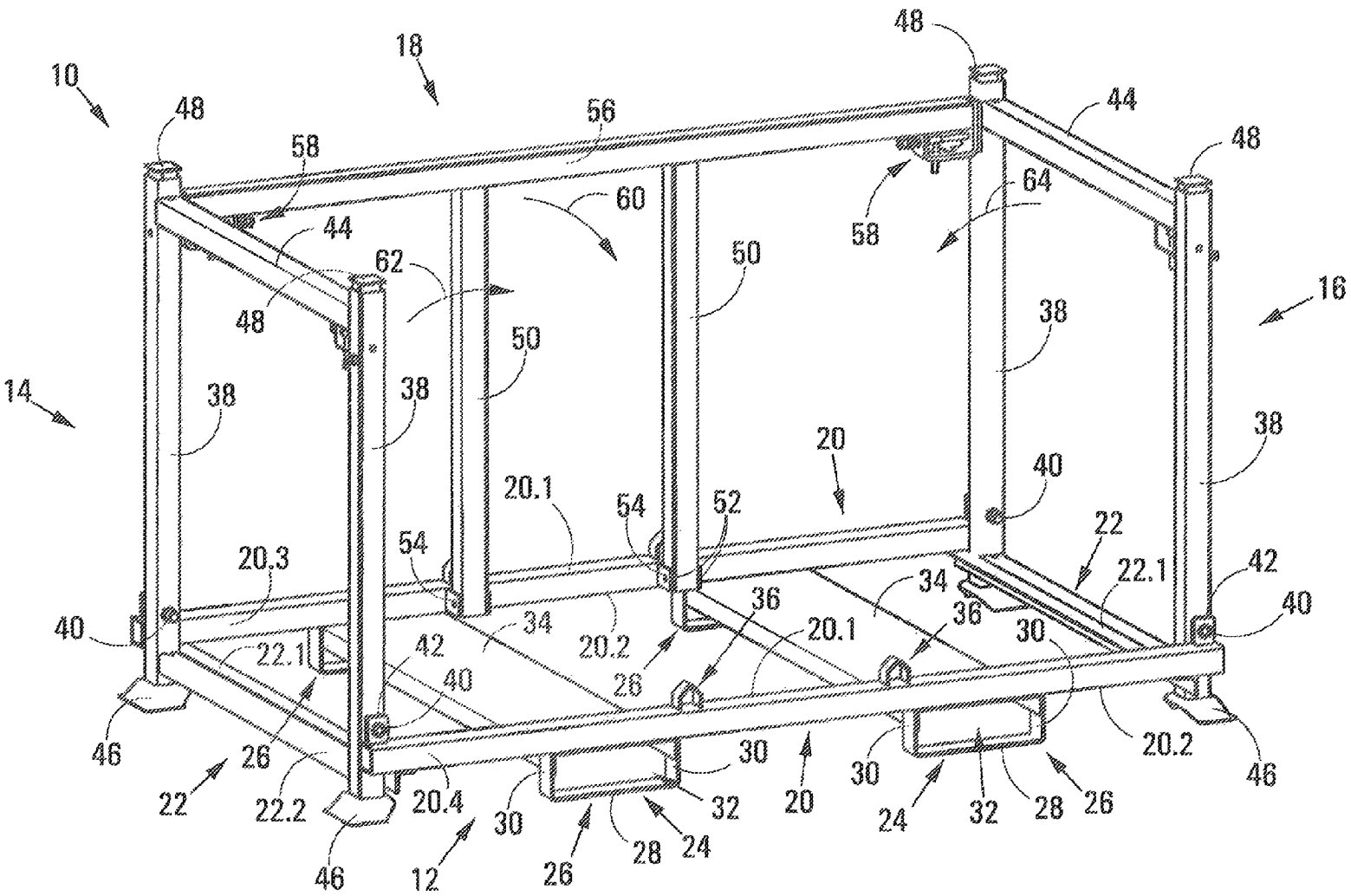
FIG. 1 shows a three-dimensional view of a collapsible container in accordance with the invention in its erect condition.

In FIGS. 1 to 5 the drawings, reference numeral 10 refers generally to a collapsible container in accordance with the invention.

In the embodiment shown in FIGS. 1 to 5, the container 10 includes a base, generally indicated by reference numeral 12, two ends, generally indicated by reference numerals 14 and 16 and one side, generally indicated by reference numeral 18.

The base 12 is in the form of a rectangular frame comprising two parallel side members 20 which are formed of steel box section or square tubing. Each side member 20 has a top surface 20.1 a bottom surface 20.2 an inner surface 20.3 and an outer surface 20.4. The base 12 further includes a pair of parallel end members 22 each of which has a horizontal limb 22.1 and perpendicular vertical limb 22.2. The horizontal limbs 22.1 of the end members 22 are secured to the bottom surfaces 20.2 of the side members 20, e.g. by welding with the vertical limbs 22.2 depending downwardly from the outer edges of the horizontal limbs 22.1.

The container 10 includes lifting element guide formations, generally indicated by reference numeral 24, connected to the base 12. More particularly, each lifting element guide formation 24 includes a pair of u- or staple-shaped members 26 connected to and protruding downwardly from the bottom surface 20.2 of the side members 20 in register with one another. Each staple member 26 is typically formed from a length of flat bar and has a central member 28 and a pair of vertical members 30 protruding upwardly from opposite ends of the central member 28, the free ends of the vertical members 30 being secured, e.g. by welding, to the bottom surfaces 20.2 of the side members 20 such that the central members 28 extend parallel with the side members 20. A rectangular aperture 32 is accordingly defined between the staple member 26 and the bottom surface 20.2 of the associated side member within which a lifting element is receivable as described in more detail here below. Optionally, a downwardly open guide channel 34 is connected to and extends between registering staple members 26. The channels 34 serve both to guide the tines of a forklift or the rolling supports of a pallet jack and to reinforce the base 12. The apertures 32 typically have a width W (FIG. 5) of approximately 300 mm and a depth of about 95 mm such that a tine of a fork lift or a rolling support of a pallet jack is receivable therein. The spacing between the lifting element guide formations 24 is selected to correspond to the standard spacing between the tines of a forklift or rolling support of a pallet jack.

A pair of longitudinally spaced apart locating formations 36 is attached to and protrudes upwardly from the top surface 20.1 of each of the side members 20. Each locating formation 36 is typically formed of flat bar the spacing P (FIG. 4) between outer surfaces of the locating formations 36 is selected to be slightly less than the spacing L (FIG. 4) between inner surfaces of the staple members to assist in locating collapsible containers in a stack as described in more detail here below.

Each end 14,16 comprises a pair of posts 38 which are pivotally connected to the base 12 by means of pivot pins 40 which extend through holes in lugs 42 attached to and protruding upwardly from the top surface 20.1 of the side member 20 adjacent the end thereof and corresponding holes in the post 38. A transverse connecting member 44 is connected (e.g. by welding) to and extends between the posts 38 adjacent their ends which are remote from the pins 40. A foot 46 is connected to the operatively lower end of each post and the upper end of each post is provided with a formation 48 which is receivable within the foot 46 of a similar container in order to facilitate stacking of the containers 10 when in their erect condition. Accordingly, the feet 46 and formations 48 form complementary support formations which cooperate to locate adjacent containers in a stack of containers relative to one another.

The side 18 includes a pair of posts 50 which are pivotally connected to the base 12 by means of pairs of lugs 52 which extend inwardly from the inner surface 20.3 of the side member 20. A pivot pin 54 extends through registering holes in the lugs 52 and post 50. A longitudinal member 56 is connected to the free ends of the posts 50 with latch arrangements 58 being provided at the ends of the longitudinal member 56 and configured releasably to engage the ends 14, 16, respectively. If desired the container could include a pair of sides 18 extending between the ends 14, 16.

As can best be seen in FIG. 1 of the drawings, when the collapsible container 10 is in its erect condition, the ends 14,16 extend vertically upwardly from the base 12 and the or each side 18 extends between the ends and upwardly from the base to define a generally parallelepiped volume within which goods to be transported are receivable. The container rests on a support surface, e.g. on the ground on the feet 46 and the staple members 26. In it's erect condition, one container 10 can be stacked on top of another by locating the feet 46 of the upper container over the support formations 48 of the lower container.

In its erect condition, the container 10 is used to transport goods in a conventional fashion. In this regard, the lifting element guide formations 24 can be engaged with the tines of a forklift truck or the rolling supports of a pallet jack in a conventional fashion. It will be appreciated that depending on the nature of the goods to be transported, the base, sides and ends could be clad to form an enclosed volume. Further, if desired the container could include a top to form, in its erect condition, a fully enclosed volume.

Figure 2:
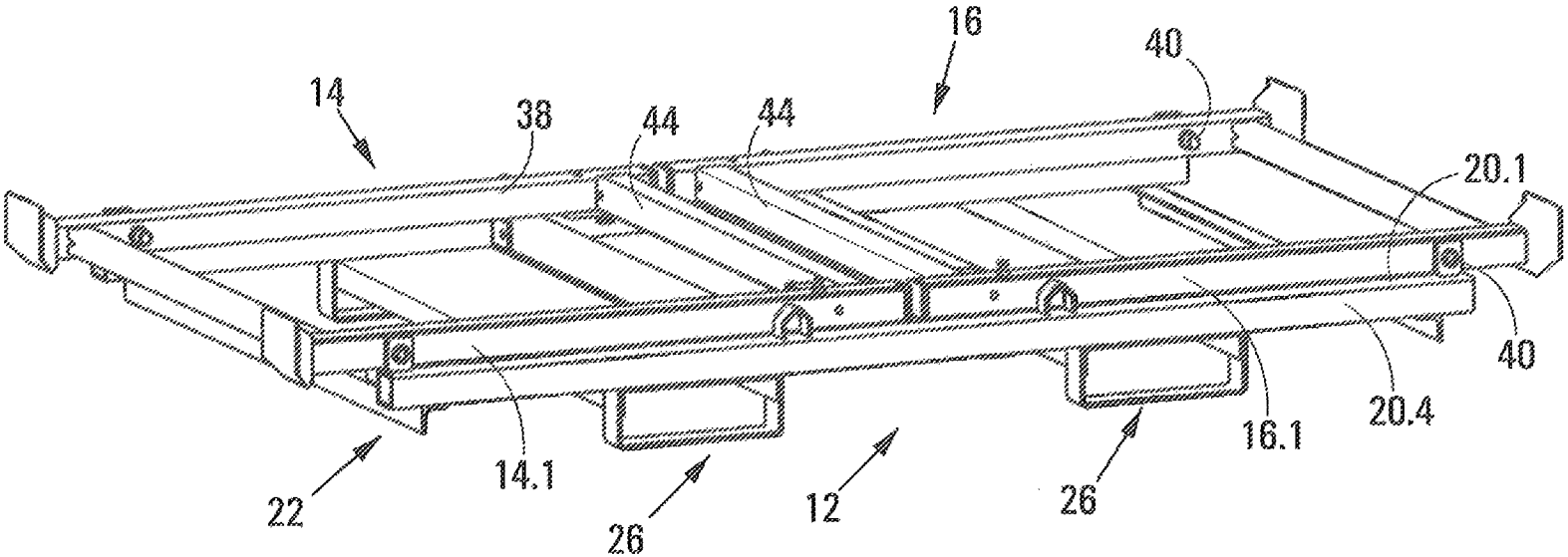
FIG. 2 shows a three-dimensional view of the container of FIG. 1 in its collapsed condition.

In order to displace the container 10 to its collapsed condition, the latch arrangements 58 are released and the side 18 is pivotally displaced in the direction of arrow 60 until it lies between the side members 20. The ends 14,16 are then displaced in the direction of arrows 62,64, respectively. By virtue of the fact that the lugs 40 protrude above the side members 20, in their displaced condition, the ends 14,16 lie parallel with and slightly above the side members 20, as illustrated in FIG. 2. Further, as can be seen in FIG. 2 of the drawings, outer surfaces 14.1, 16.1 of the ends 14,16 are spaced inwardly from the outer surfaces 20.4 of the side members, thereby exposing at least part of the top surfaces 20.1 of the side members 20.

Figure 3:
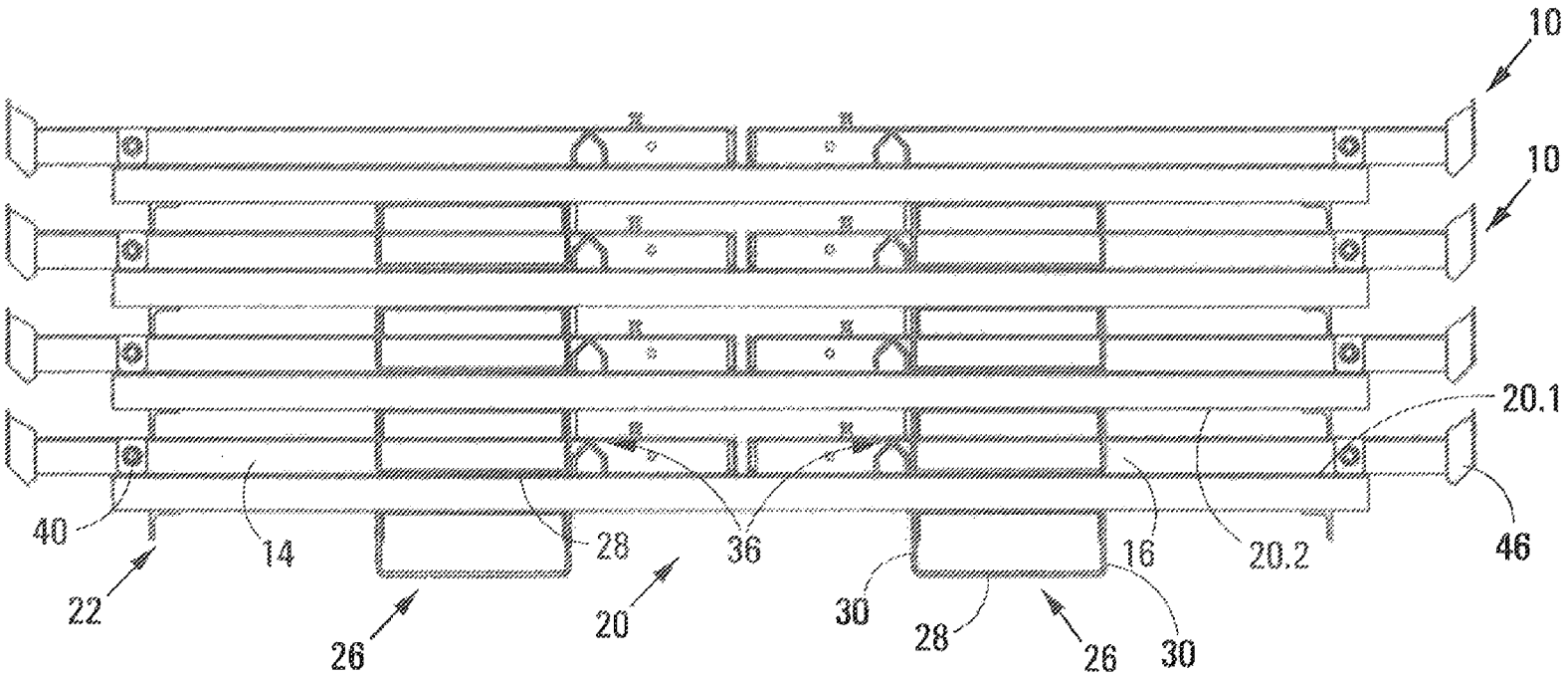
FIG. 3 shows a front view of a plurality of the containers of FIGS. 1 and 2 in their collapsed conditions and arranged in a stack.
Figure 4:
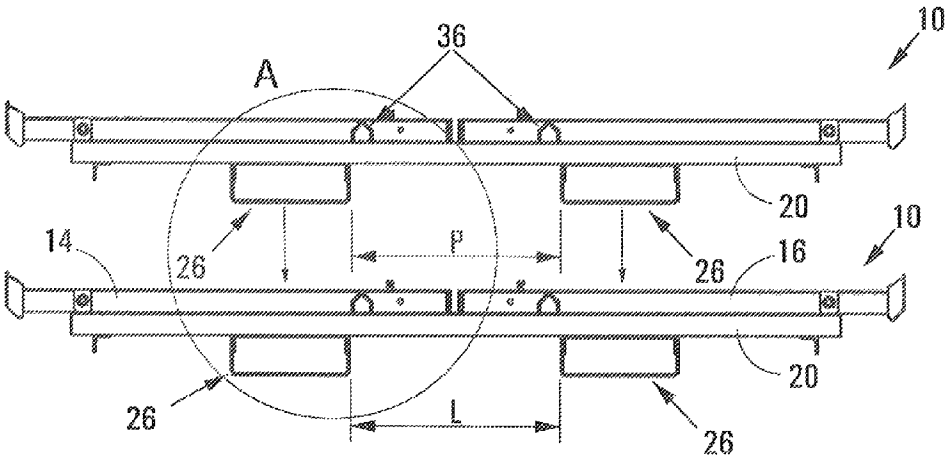
FIG. 4 shows an exploded front view of two of the containers in their collapsed condition, being stacked one on top of the other.
Figure 5:
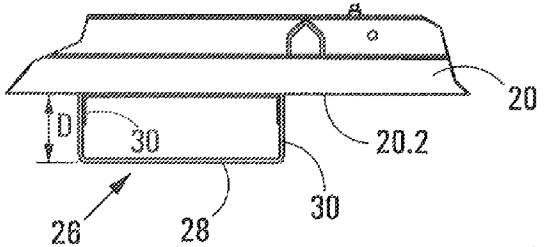
FIG. 5 shows, on an enlarged scale, part of the containers of FIG. 4 illustrating the location of one container relative to a subjacent container.
Figure 5:
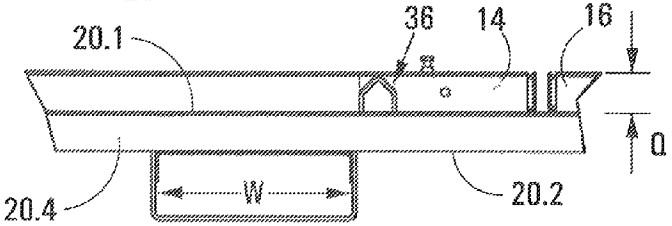
Figure 6:
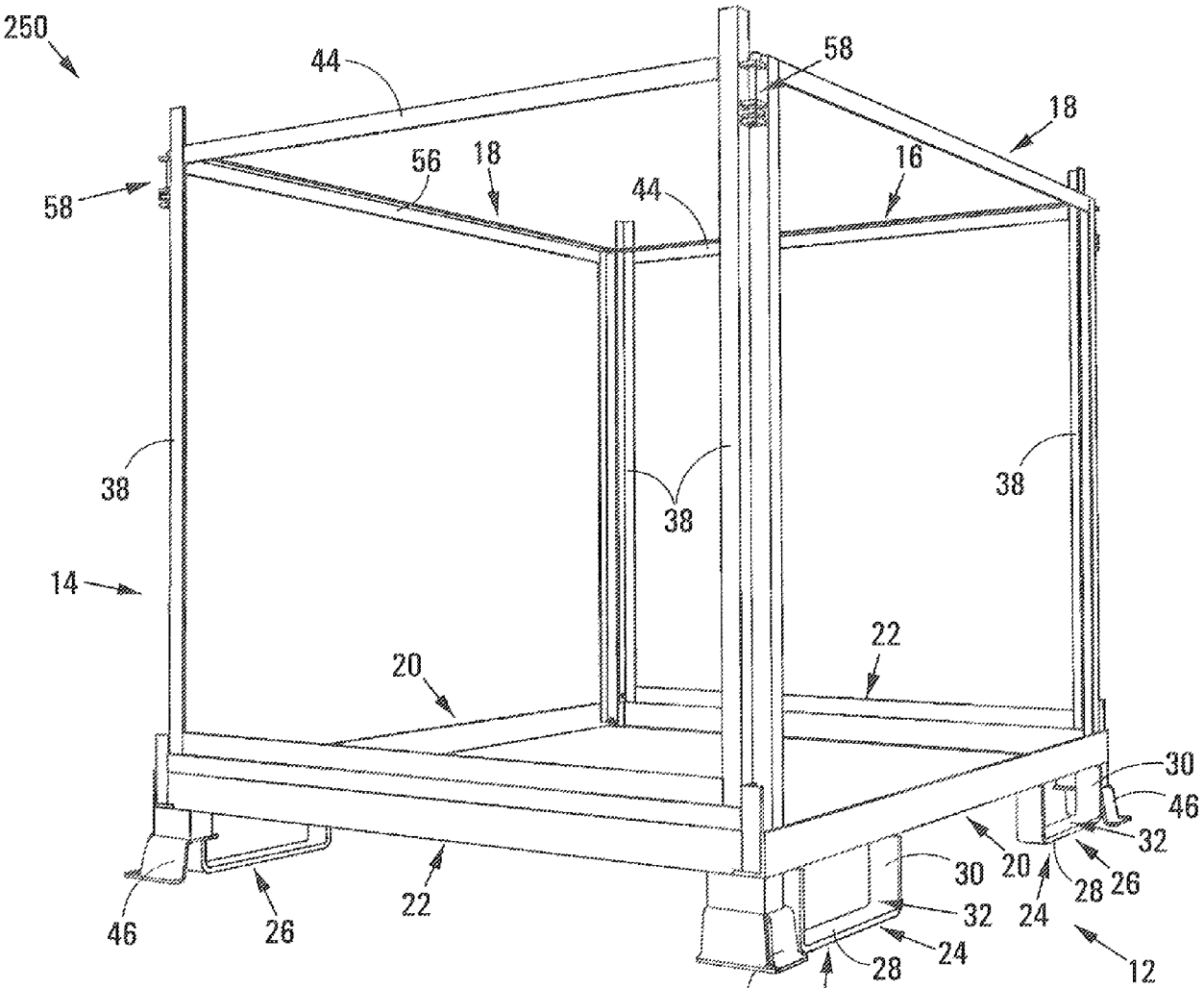
FIG. 6 shows a three-dimensional view of another collapsible container in accordance with the invention in its erect condition.
Figure 7:
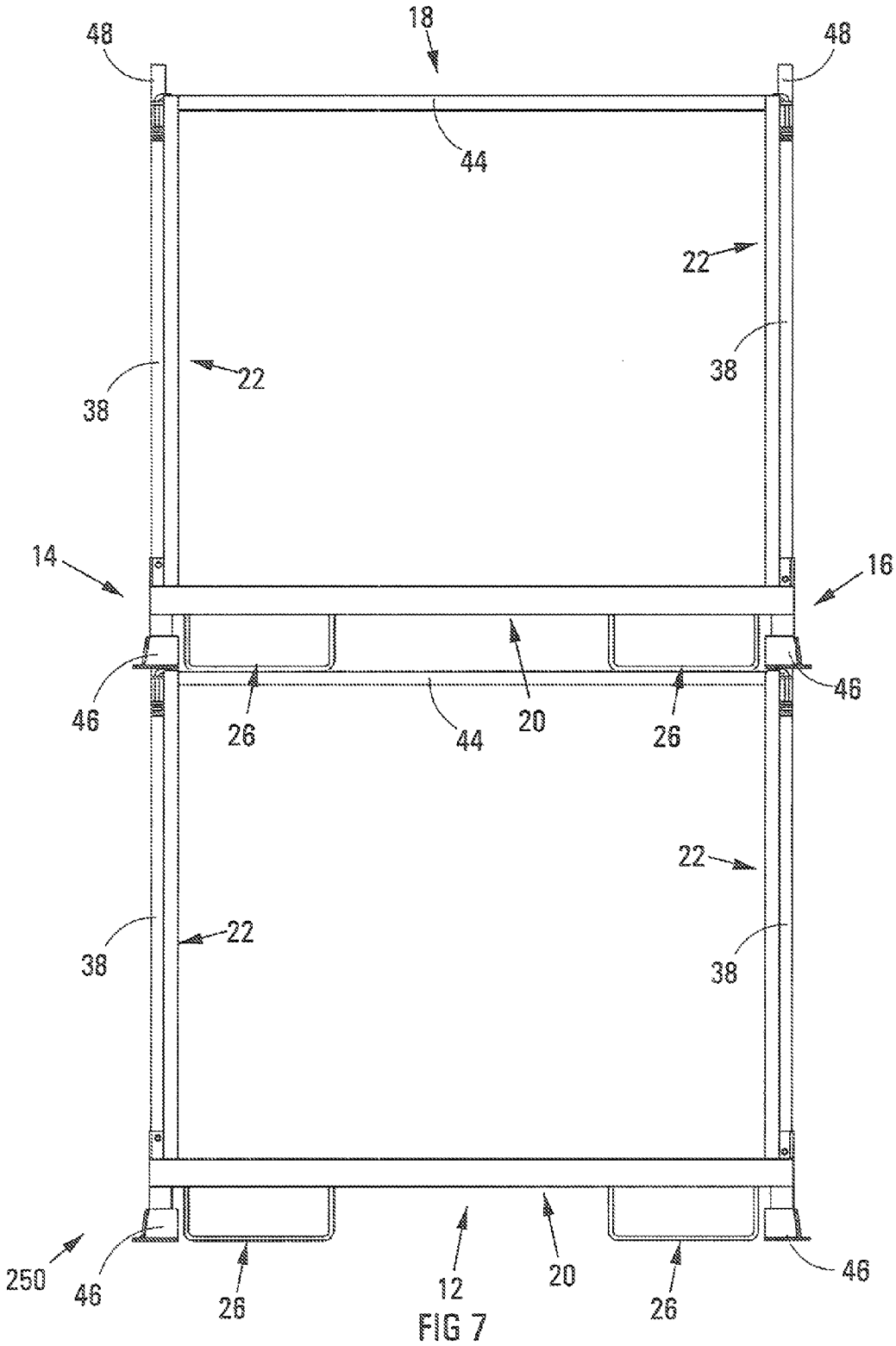
FIG. 7 shows a front view of two of the containers of FIG. 6 in a stacked arrangement.
Figure 8:
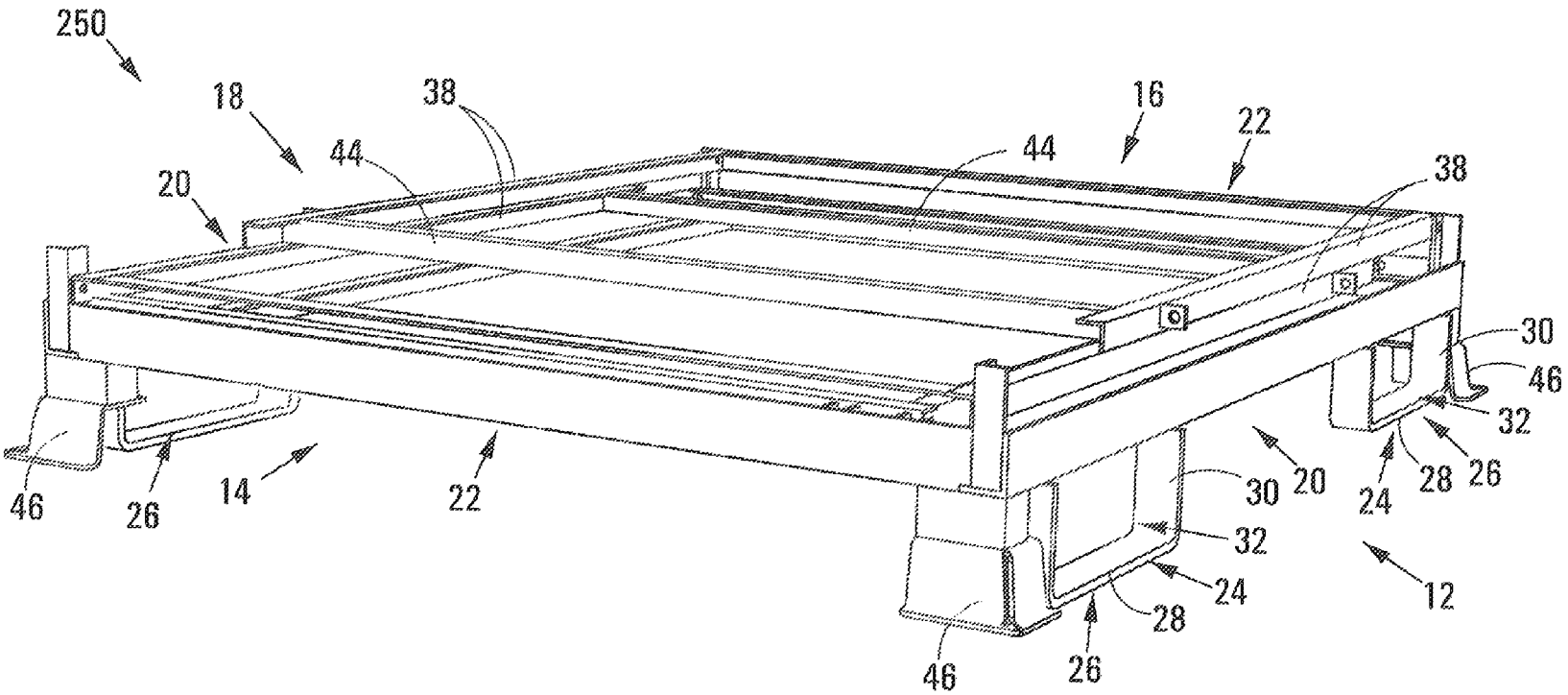
FIG. 8 shows a three-dimensional view of the container of FIG. 6 in its collapsed condition.
Figure 9:
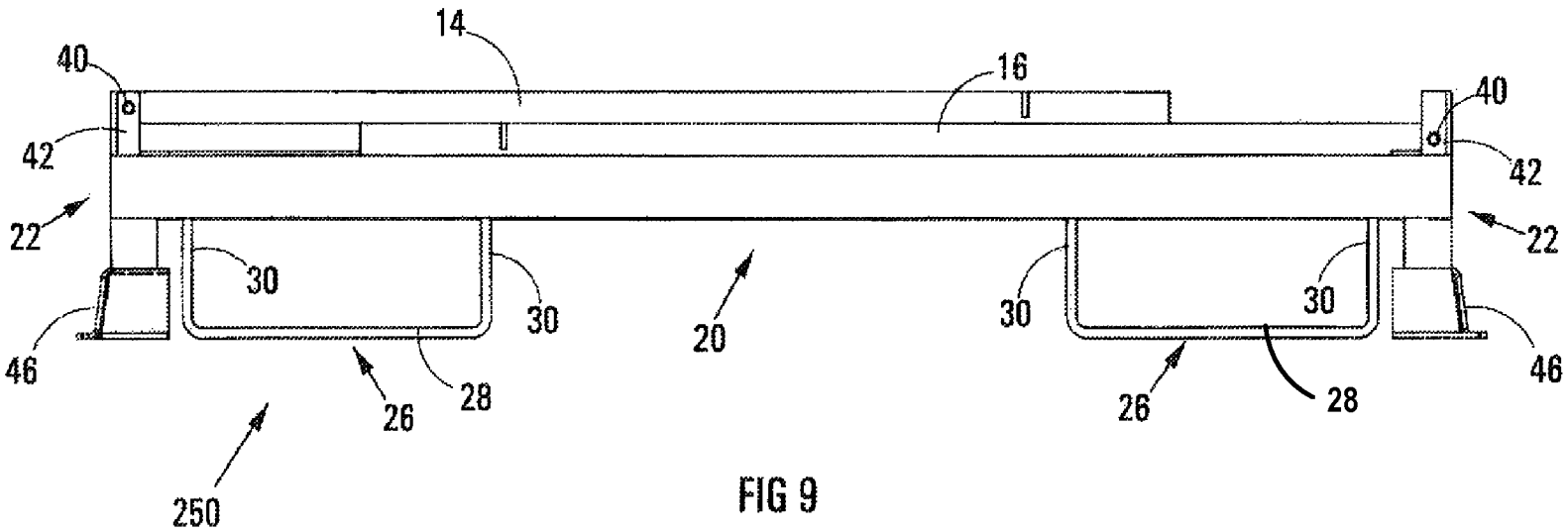
FIG. 9 shows a front view of the container of FIG. 8.
Figure 10:
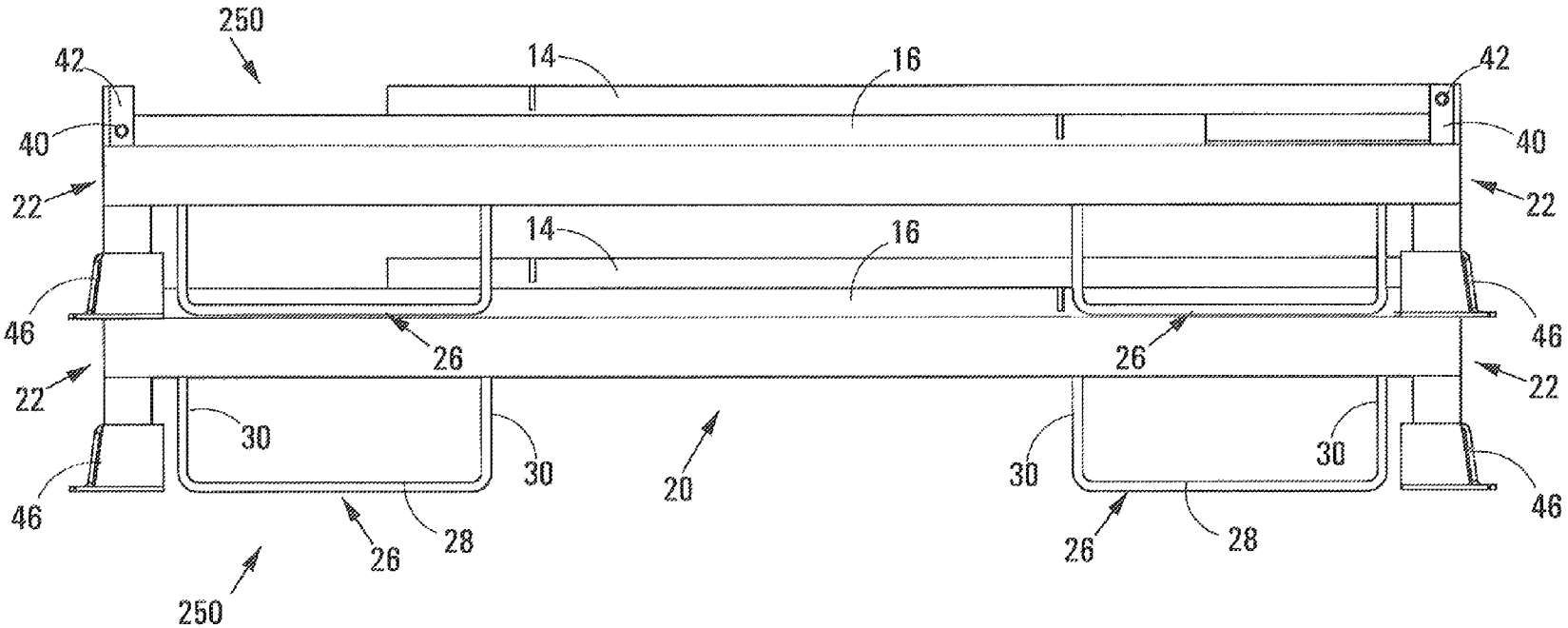
FIG. 10 shows a front view of two of the containers of FIG. 9 arranged in a stack.

In order to stack the containers 10 when in their collapsed conditions, as illustrated in FIGS. 3, 4 and 5 of the drawings, the staple members 26 of an upper container 10 are positioned such that they rest on the exposed upper surfaces 20.1 of the side members 20 of a lower or subjacent container. It will be appreciated that the ends 14,16 of the subjacent container will be positioned between the staple members 26 of the upper container. However, the height Q (FIG. 5) that the ends 14,16 protrude above the side members 20 is substantially less than the depth D of the staple members 26 such that the bottom surfaces 20.2 of the side members of the upper container are spaced above the ends 14,16 of the lower container by an amount of at least 45 mm.

It will be appreciated that a pallet jack will only be used in order to displace a container resting on the ground and accordingly it is only this container that the full depth D of the lifting element locating formation will be required. For any other container 10 arranged in the stack, use will be made of a forklift in order to raise the container and any containers above it. The tines of a forklift are, however, substantially shallower than the rolling supports of a pallet jack and accordingly the space between adjacent containers 10 arranged in the stack, will be sufficient to permit the insertion of the tines of a forklift into the lifting element locating formations.

Further, as can best be seen in FIGS. 3, 4 and 5 of the drawings, when the upper container 10 is placed on the subjacent container, the locating formations 36 are positioned between the staple members 26 of the upper container and thereby serve to restrict longitudinal displacement of the containers relative to one another. Lateral displacement of the containers relative to one another is restricted by the provision of the ends 14 between the staple members 26.

Reference is now made to FIGS. 6 to 10 of the drawings, in which reference numeral 250 refers generally to another collapsible container in accordance with the invention and, unless otherwise indicated, the same reference numerals used above are used to designate similar parts.

One difference between the container 250 and the container 10 is that, in the container 250, the feet 46 are fixed to the base 12 and form downwardly open support formations. As can best be seen in FIG. 7 of the drawings, when the container 250 is in its erect condition, the feet 46 cooperate with the formations 48 of a subjacent container 250 to facilitate stacking of containers 250, in their erect condition, on top of one another. Further, as can best be seen in FIG. 10 of the drawings, when in its collapsed condition, the feet 46 of one container cooperate with the upper ends of the lugs 42 of a subjacent container to facilitate stacking of the containers one on top of the other.

It will be appreciated that, in view of the fact that stacked containers 250 are located relative to one another by the feet and the associated complementary support formation, i.e. 48 or 42 depending on whether or not the container is in its erect or collapsed condition, the use of the formations 36 is not required.

A further advantage with this arrangement is that, when the container 250 is displaced to its collapsed condition, the feet 46 do not protrude longitudinally beyond the base, as is the case with the container 10. This further reduces the volume occupied by the collapsed container 250 when compared with the container 10.

Another difference between the container 250 and the container 10 is that, in the case of the container 250, the ends 14, 16 each have a height which is greater than half of the length of the base 12. As a result, as can clearly be seen in FIG. 9 of the drawings, when the ends 14, 16 are displaced to their collapsed condition, they overlap. To facilitate this arrangement, the end 16 is pivotally connected to the associated lugs 42 at an elevation which is below that of the pivotal connection of the end 14 to the associated lugs. Accordingly, when displaced into their collapsed condition, the ends 14, 16 overlap and lie substantially parallel to one another. Naturally, various other variations of the container are possible whilst remaining within the scope of the invention.

Yet another difference between the container 250 and the container 10 is that the container 250 does not make use of the guide channels 34. Optionally, a plate or panel is attached to the base. This arrangement has the advantage that it permits four-way entry of the tines of a forklift or rolling supports of a pallet jack, i.e. from either side or either end of the container.

In contrast with prior art collapsible containers of which the inventor is aware, in which, in their collapsed conditions, the containers were simply stacked one on top of another such that the spacing between containers was the full height of the lifting element guide formations, the nesting arrangement in accordance with this invention reduces the height of a stack by approximately 45 to 50 mm for each container in the stack. This will permit substantially more containers to be arranged in a stack of a given height than is the case with the prior art leading to a substantial increase in space efficiency and hence the costs associated with transportation of the containers in their collapsed condition. This naturally has cost benefits for the transportation of the goods contained within the container when in its erect condition.

The inventor believes that a container in accordance with the invention will be easy to use and in addition, the provision of the locating formations ensures stable and safe stacking of the containers.

I claim:

1. A collapsible container comprising:

a base;

two pairs of lifting element guide formations, the lifting element guide formations in each pair protruding downwardly from the base at transversely spaced registering positions; and at least two ends connected to the base for displacement between an erect condition wherein the at least two ends extend upwardly from opposed ends of the base and a collapsed condition wherein the at least two ends are generally parallel with the base, the at least two ends having a width which is less than a spacing between the lifting element guide formations in one of the two pairs such that when two or more of the containers are arranged in a stack, in their collapsed conditions, ends of one of the two or more containers are positioned between the lifting element guide formations of a container positioned immediately above the one of the two or more containers in the stack.

2. A collapsible container as claimed in claim 1, further comprising complementary upper and lower support formations on the container configured such that when the container is arranged to occupy an intermediate position in the stack, the lower support formations of the container in the intermediate position are configured to cooperate with the upper support formations of a lower container, and the upper support formations of the container in the intermediate position are configured to cooperate with lower support formations of an upper container.

3. A collapsible container as claimed in claim 1, wherein the depth of the lifting element guide formations is greater than the height that the ends protrude above the base when the container is in its collapsed condition such that when two or more containers are arranged in a stack the base of said one container is supported with clearance above the ends of the subjacent container.

4. A collapsible container as claimed in claim 3, wherein the spacing between the base of one container and the ends of the subjacent container is at least 45 mm to permit insertion of forklift tines between the containers.

5. A collapsible container as claimed in claim 1, the base comprising a frame comprising a pair of parallel side members and a pair of parallel end members connected to and extending between the side members, the side members being formed of square tubing and the end members being formed of angle iron that is secured to bottom surfaces of the end members.

6. A collapsible container as claimed in claim 5, the lifting element guide formations comprising staple-shaped members which are attached to and depend from the side members.

7. A collapsible container as claimed in claim 6, wherein the staple-shaped members are formed from flat bar, each of the staple-shaped members includes a central portion and two end portions which are then perpendicular to the central portion, the central portion extending parallel to any side member to which the staple-shaped member is attached.

8. A collapsible container as claimed in claim 6, wherein a downwardly open guide channel is connected to and extends between an associated pair of the staple-shaped members.

9. A collapsible container as claimed in claim 1, wherein a pair of longitudinally spaced locating formations protrude upwardly from at least one of the side members, the spatial arrangement of the locating formations being complementary to that of the lifting element guide formations such that they cooperate and serve to locate the two or more containers arranged in the stack relative to one another.

10. A collapsible container as claimed in claim 1, wherein the ends are pivotally connected to the base.

11. A collapsible container as claimed in claim 1, further comprising at least one side that is disconnectedly connectable to the ends, the side being pivotally connected to the base for pivotal displacement between an erect condition and a collapsed condition, the side, in its collapsed condition, being receivable, at least partially, within the base.

12. A collapsible container as claimed in claim 11, wherein the container comprises two sides, which, in the erect condition of the container extend upwardly from opposite sides of the base.

* * * * *